US007527452B2

(12) United States Patent
Theurer et al.

(10) Patent No.: US 7,527,452 B2
(45) Date of Patent: May 5, 2009

(54) TAMPING TINE FOR A TAMPING MACHINE

(75) Inventors: Josef Theurer, Vienna (AT); Friedrich Peitl, Linz (AT)

(73) Assignee: Franz Plasser Bahnbaumaschinen-Industrie-Gesellschaft mbH, Vienna (AT)

( * ) Notice: Subject to any disclaimer, the term of this patent is extended or adjusted under 35 U.S.C. 154(b) by 1077 days.

(21) Appl. No.: 10/348,437

(22) Filed: Jan. 21, 2003

(65) Prior Publication Data

US 2003/0138295 A1 Jul. 24, 2003

(30) Foreign Application Priority Data

Jan. 18, 2002 (AT) ..... GM 23/2002

(51) Int. Cl.
*E01C 19/30* (2006.01)

(52) U.S. Cl. ..... 404/133.05; 104/10; 175/426

(58) Field of Classification Search ..... 404/133.05, 404/133.1, 133.2; 104/10; 37/460; 175/426
See application file for complete search history.

(56) References Cited

U.S. PATENT DOCUMENTS 3,581,664 A * 6/1971 Kruse et al. ..... 104/10
3,677,187 A * 7/1972 Stewart ..... 104/10
3,793,960 A * 2/1974 McKenry ..... 104/10
3,826,025 A * 7/1974 Elliott ..... 37/455
4,062,291 A * 12/1977 Vick et al. ..... 104/10
4,068,594 A * 1/1978 Crowell ..... 104/10
4,160,419 A * 7/1979 Stewart ..... 104/10
4,922,828 A * 5/1990 Theurer et al. ..... 104/10
5,077,918 A * 1/1992 Garman ..... 37/452
5,261,763 A 11/1993 Crowell
5,809,895 A * 9/1998 Sandsted et al. ..... 104/10
5,813,474 A * 9/1998 Manway ..... 172/701.3
6,003,617 A * 12/1999 McSweeney et al. ..... 172/719

FOREIGN PATENT DOCUMENTS

GB 2201708 A * 9/1988

* cited by examiner

*Primary Examiner*—Thomas A Beach
(74) *Attorney, Agent, or Firm*—Laurence A. Greenberg; Werner H. Stemer; Ralph E. Locher

(57) ABSTRACT

Hardened metal inserts are inserted in a tine plate of a tamping tine for tamping ballast of a railroad track. The cylindrical inserts have a boundary surface bordering on a side surface of the tine plate, thus forming a part thereof. Owing to that configuration, the abrasion resistance of the side surfaces can be improved.

6 Claims, 2 Drawing Sheets

Fig. 3
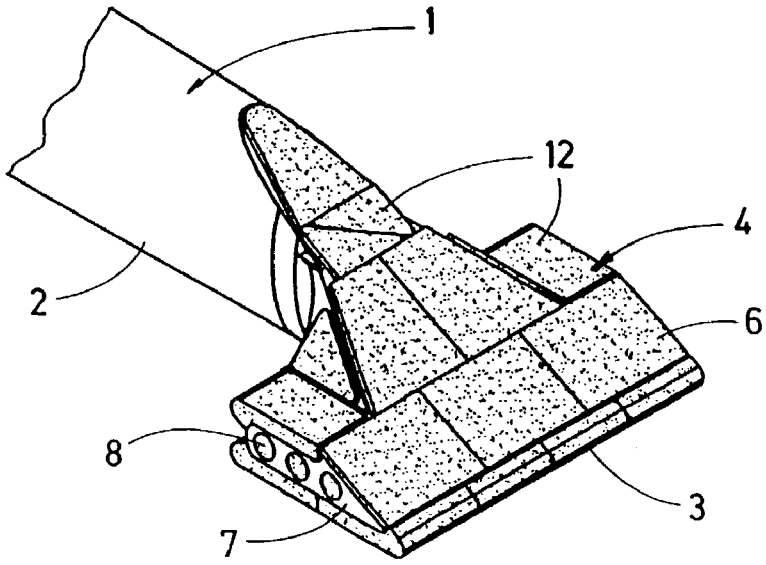
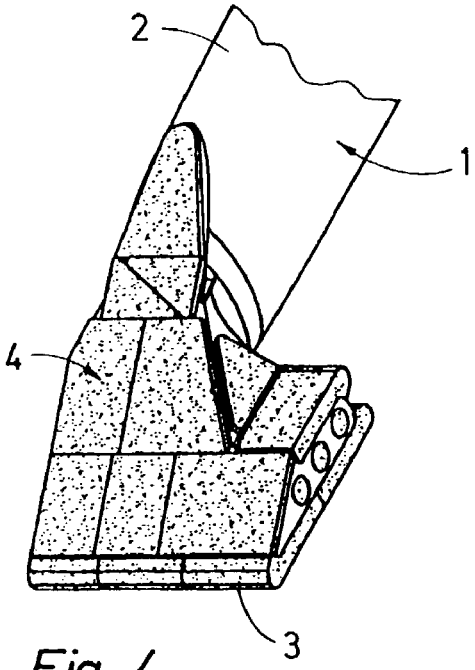
Fig. 4
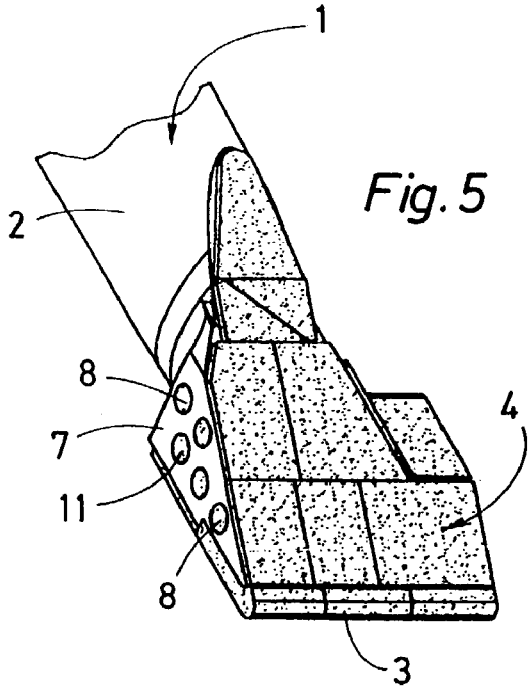
Fig. 5

TAMPING TINE FOR A TAMPING MACHINE

BACKGROUND OF THE INVENTION

Field of the Invention

The present invention relates, in general, to a tamping tine for a tamping machine for tamping ballast underneath a railroad track.

U.S. Pat. No. 5,261,763 to Crowell describes a tamping tine of this type, referred to as a tamping tool, having hardened metal plates that are fastened to both the tine plate and the lower end of the shank in order to optimize the resistance to abrasion.

SUMMARY OF THE INVENTION

It is an object of the invention to provide a tamping tine for a tamping machine which overcomes the disadvantages of the heretofore-known devices and methods of this general type and which is improved in that it achieves even better abrasion resistance.

With the foregoing and other objects in view there is provided, in accordance with the invention, a tamping tine for a tamping machine for tamping ballast underneath a railroad track, comprising:

a shank having a lower end;

a tine plate disposed at the lower end of the shank and having a bottom edge spaced from the shank, the tine plate having side surfaces, spaced from one another in a direction of the bottom edge and extending substantially perpendicularly to the bottom edge, and the tine plate having a front surface and a rear surface connected to one another by the side surfaces; and hardened metal inserts in the tine plate, the inserts having a cylindrical shape and having a boundary surface substantially forming part of a respective one of the side surfaces of the tine plate.

In other words, according to one aspect of the present invention, a tamping tine for a tamping machine for tamping ballast underneath a railroad track is provided, the tamping tine including a shank having a lower end. A tine plate is arranged at the lower end and has a bottom edge spaced from the shank, the tine plate including side surfaces, spaced from one another in the direction of the bottom edge and extending perpendicularly thereto, and a front surface and rear surface connected to one another by said side surfaces. Hardened metal inserts are arranged in the tine plate, the inserts being of cylindrical shape and having a boundary surface which forms part of the side surface of the tine plate.

In a tamping tine configured in this way, the hardened metal inserts can be securely anchored within corresponding bores of the tine plate, thus ensuring that the inserts are not directly subjected to the significant effects of the forces acting upon the narrow side surfaces of the tine plate during tamping operations. In this way, the inserts are protected from the danger of breaking off, while at the same time providing reinforcement and better abrasion resistance of the tine plate.

In accordance with an added feature of the invention, the hardened metal inserts have a longitudinal axis extending parallel to the bottom edge and the front surface of the tine plate.

In accordance with an additional feature of the invention, the hardened metal inserts are arranged one above another at each of the side surfaces, along a line extending parallel to the front surface of the tine plate.

In accordance with a concomitant feature of the invention, the hardened metal inserts are disposed in two mutually adjacent rows, each with a plurality of the hardened metal inserts positioned above one another, between the front surface and the rear surface of the tine plate.

Other features which are considered as characteristic for the invention are set forth in the appended claims.

Although the invention is illustrated and described herein as embodied in a tamping tine for a tamping machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 3 is a perspective view of the tamping tine;

FIGS. 4 and 5 are perspective views of further exemplary embodiments of the tamping tine according to the invention.

DESCRIPTION OF THE PREFERRED EMBODIMENTS

Figure 1:
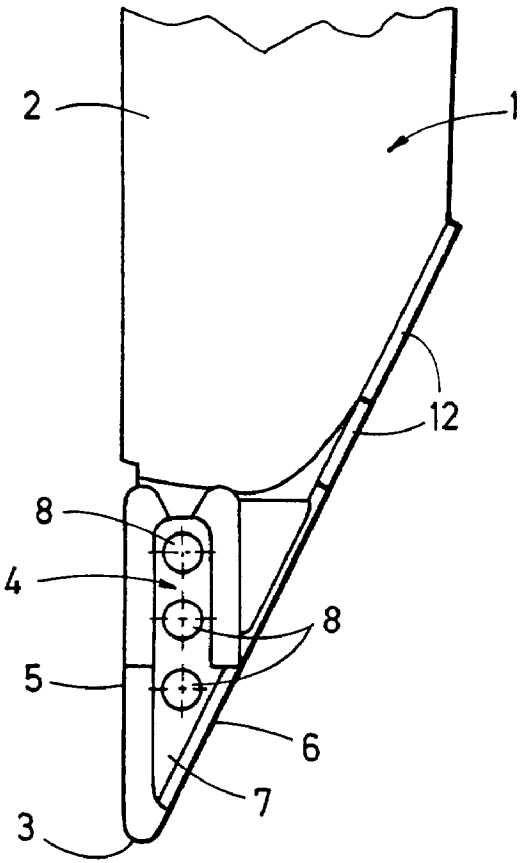
FIG. 1 is a side elevational view of a lower segment of a tamping time formed with hardened metal inserts according to the invention.
Figure 2:
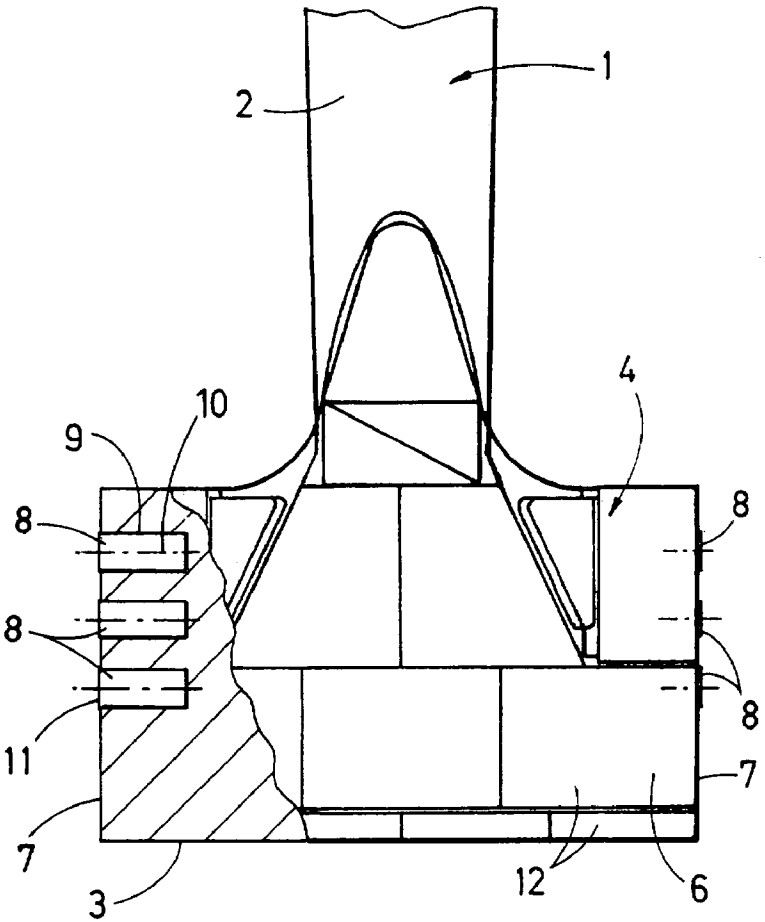
FIG. 2 is a rear view thereof.

Referring now to the figures of the drawing in detail and first, particularly, to FIGS. 1, 2, and 3 thereof, there is shown a tamping tine 1 which is composed of a shank 2 and a tine plate 4. The tine plate 4 is fastened to the lower end of the shank and it has a bottom edge 3. The tine plate 4 comprises a front surface 5 and a rear surface 6. Laterally, the tine plate 4 is delimited by side surfaces 7 which extend perpendicularly to the bottom edge 3 and connect the front surface 5 to the rear surface 6 of the tine plate 4.

As can be seen particularly clearly in FIG. 2, hardened metal inserts 8 are provided in the region of the side surfaces 7. The inserts 8 are cylindrical in shape and having a longitudinal axis 10. Each hardened metal insert 8 is positioned in a corresponding bore 9 of the tine plate 4, oriented so that the longitudinal axis 10 extends parallel to the bottom edge 3 and the front surface 5, and has a circular boundary surface 11 which constitutes part of the side surface 7.

Three of these hardened metal inserts 8 are provided at each side surface 7 and they are positioned one above the other parallel to the front surface 5. Both the front surface 5 and the rear surface 6 are completely covered by small hardened metal plates 12.

Referring now to FIGS. 4 and 5, there is illustrated a variant of a tamping tine 1 in which the tine plate 4 is asymmetrical in shape (relative to the longitudinal axis of the tine) and extends to only one side of the shank 2. As is visible in FIG. 5, it is also possible, if desired, to arrange two rows of hardened metal inserts 8 between the front surface 5 and rear surface 6, each row containing several inserts positioned one above the other. This embodiment is particularly suitable in cases where the side surface 7 of the tine plate 4 extends over a larger area.

Figure 6:
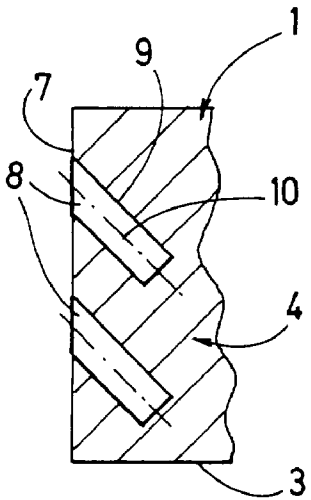
FIG. 6 is a partial sectional view of yet another exemplary embodiment of the tamping tine according to the invention.

According to another variant, shown in FIG. 6, the hardened metal inserts 8 can also be arranged so that their longitudinal axes 10 are oriented at an angle with regard to the bottom edge 3 of the tine plate 4.

Furthermore, the boundary surfaces 11 of the hardened metal inserts 8 may expediently project by about 0.5 to 1.5 millimeters beyond a plane formed by the side surfaces 7 of the tine plates 4.

While the invention has been illustrated and described as embodied in a tamping tine for a tamping machine, it is not intended to be limited to the details shown since various modifications and structural changes may be made without departing in any way from the spirit of the present invention.

We claim:

1. A tamping tine for a tamping machine for tamping ballast underneath a railroad track, comprising:

a shank having a lower end;

a tine plate disposed at said lower end of said shank and having a bottom edge spaced from said shank, said tine plate having side surfaces, spaced from one another in a direction of said bottom edge and extending substantially perpendicularly to said bottom edge, and said tine plate having a front surface and a rear surface connected to one another by said side surfaces; and hardened metal inserts in said tine plate, said inserts having a cylindrical shape and having a boundary surface substantially lying in a plane with and forming a part of a respective one of said side surfaces of said tine plate.

2. The tamping tine according to claim 1, wherein each said hardened metal insert has a longitudinal axis extending parallel to said bottom edge and said front surface of said tine plate.

3. The tamping tine according to claim 1, wherein a plurality of said hardened metal inserts are arranged one above another at each of said side surfaces, along a line extending parallel to said front surface of said tine plate.

4. The tamping tine according to claim 1, wherein said hardened metal inserts are disposed in two mutually adjacent rows, each with a plurality of said hardened metal inserts positioned above one another, between said front surface and said rear surface of said tine plate.

5. A tamping tine for a tamping machine for tamping ballast underneath a railroad track, comprising:

a shank having a lower end;

a tine plate disposed at said lower end of said shank and having a bottom edge spaced from said shank, said tine plate having side surfaces, spaced from one another in a direction of said bottom edge and extending substantially perpendicularly to said bottom edge;

said tine plate having a front surface and a rear surface extending between said side surfaces;

hard metal plates substantially completely covering said front surface, said rear surface, and said bottom edge;

said hard metal plates having side surfaces widening each of said side surfaces of said tine plate at said front surface, said rear surface, and said bottom edge by a given width;

a plurality of hardened metal inserts in said tine plate, said inserts having a cylindrical shape and having boundary surfaces forming a part of said side surfaces of said tine plate;

said metal inserts being spaced from said hard metal plates at said front surfaces and said rear surface; and said metal inserts in one of said side surfaces of said tine plate being spaced from said metal inserts on the opposite said side surface.

6. The tamping tine according to claim 5, wherein a plurality of said cylindrical hardened metal inserts are arranged one above another at each of said side surfaces and extending parallel to said front surface of said tine plate.

* * * * *